US006575711B1

(12) United States Patent
Pugnet et al.

(10) Patent No.: US 6,575,711 B1
(45) Date of Patent: Jun. 10, 2003

(54) METHOD AND DEVICE FOR CONTROLLING A TURBO-MACHINE SO AS TO LIMIT CLOGGING OF THE TURBO-MACHINE INTERNAL PARTS WITH IMPURITIES DERIVED FROM A PROCESS GAS

(75) Inventors: Jean-Marc Pugnet, Le Creusot (FR); Henri Hus, Igny (FR); Daniel Tricot, Le Creusot (FR)

(73) Assignee: Thermodyn, Courbevoie (FR)

( * ) Notice: Subject to any disclaimer, the term of this patent is extended or adjusted under 35 U.S.C. 154(b) by 0 days.

(21) Appl. No.: 09/890,187

(22) PCT Filed: Jan. 5, 2000

(86) PCT No.: PCT/FR00/00013

§ 371 (c)(1),
(2), (4) Date: Jul. 30, 2001

(87) PCT Pub. No.: WO00/45034

PCT Pub. Date: Aug. 3, 2000

(30) Foreign Application Priority Data

Jan. 29, 1999 (FR) ..... 99 01047

(51) Int. Cl.[7] ..... F04B 23/00; F04B 19/24; F04D 31/00; B08B 7/04

(52) U.S. Cl. ..... 417/313; 417/53; 415/116; 134/10

(58) Field of Search ..... 417/313, 53; 415/116, 415/117; 134/10

(56) References Cited

U.S. PATENT DOCUMENTS

| | | | | |
|---|---|---|---|---|
| 4,898,123 A | | 2/1990 | Holcblat | 122/379 |
| 5,417,768 A | * | 5/1995 | Smith et al. | 134/10 |
| 5,526,834 A | * | 6/1996 | Mielnik et al. | 134/105 |

FOREIGN PATENT DOCUMENTS

| | | | |
|---|---|---|---|
| JP | 56-180959 | 11/1981 | |
| JP | 57-168527 | 9/1982 | |
| JP | 57-187227 | 10/1982 | |
| JP | 4-334775 | * 11/1992 | 417/313 |

* cited by examiner

*Primary Examiner*—Charles G. Freay
*Assistant Examiner*—Michael K. Gray
(74) *Attorney, Agent, or Firm*—Connolly Bove Lodge & Hutz LLP

(57) ABSTRACT

A method is disclosed which limits soiling of internal turbomachine parts from dirt originating with process gas. In between at least two successive faces in which the turbomachine is operated normally, and during which time only process gas is introduced into the inlet of the turbomachine, a cleaning phase is initiated. During this phase, a substance in a dense state is introduced at the inlet which is capable of dissolving the dirt on internal parts of the turbomachine. Process gas and the dirt dissolving substance are separated.

9 Claims, 2 Drawing Sheets

METHOD AND DEVICE FOR CONTROLLING A TURBO-MACHINE SO AS TO LIMIT CLOGGING OF THE TURBO-MACHINE INTERNAL PARTS WITH IMPURITIES DERIVED FROM A PROCESS GAS

FIELD OF THE INVENTION

The invention relates to a method and to a device for operating a turbomachine comprising an inlet and an outlet for a process gas so as to limit the soiling of the internal parts of the turbomachine with dirt originating from the process gas.

BACKGROUND OF THE INVENTION

The soiling of the internal parts of turbomachines, particularly centrifugal compressors, is a phenomenon that the user finds difficult to control or prevent.

The deposition and build-up of dirt on the aerodynamic internal parts of turbomachines may have consequences which are completely undesirable as far as performance is concerned.

On the one hand, the process carried out in the turbomachine may be modified substantially. In the case of a centrifugal compressor, the pressure and temperature levels or the rates of flow through the compressor may be modified because of the formation of deposits in the aerodynamic passages such as the vanes or the diffusers of the compressor.

On the other hand, the mechanical parts of the turbomachine may be subjected to stresses which cause them to deteriorate. It is therefore necessary to protect these mechanical parts. In particular, imbalance, variations in axial thrust, or soiling of the internal packing brought about by deposits on the dynamic parts of the turbomachine may give rise to vibrations which are detrimental to the correct running of the turbomachine.

The deposition and build-up of dirt on the internal parts of the turbomachines and, in particular, centrifugal compressors, are due to two main causes. First of all, the filters or separators placed upstream of the turbomachines are unable to hold back particles with a particle size of a few micrometers, which become deposited on the internal parts of the turbomachine. Furthermore, the pressure and temperature levels reached in the compressor, and the nature of the gases being compressed, encourage reactions of the polymerization type in the substances deposited or encourage the internal parts of the compressor to corrode under the effect of the substances deposited.

In general, the soiling of the internal parts of turbomachines and, in particular, of centrifugal compressors, is a general phenomenon which occurs in all cases during normal operation of the turbomachine. This soiling may reach such a level that it becomes necessary to shut down the turbomachine and therefore the production or manufacturing cycle that is in progress. It is therefore entirely desirable to have available means that allow dirt to be removed from the soiled internal part of a turbomachine or that allow the deposit of dirt in this internal part to be limited.

Hitherto, no general method allowing the internal parts of turbomachines to be cleaned, regardless of the type of turbomachine concerned, of the substance circulating through these turbomachines and of the type and nature of the dirt likely to be deposited in their internal parts, is known.

Each turbomachine operator attempts to remedy the soiling problem he encounters according to the type of soiling or according to the production organization characteristics.

Methods involving anti-soiling coating or solvents or chemical additives that make it possible to reduce or eliminate soiling in certain specific cases are known. In general, with a view to optimizing the availability of industrial equipment, the main methods used and which can be combined with one another, consist in:

- removing and sand-blasting the soiled parts of the turbomachines,
- periodically injecting solid or liquid particles (particularly in the form of a mist) in order to erode or dissolve the dirt,
- constantly mixing additives into the fluid passing through the turbomachine, these substances preventing or slowing polymerization,
- coating the internal parts with coating to produce non-stick surfaces.

All these methods exhibit drawbacks. In particular, these methods are expensive and their effectiveness is neither complete nor lasting.

Furthermore, each of these methods is tailored to a specific case and no method capable of widespread application is known.

Cleaning methods which are applied outside the sector of operation of the turbomachines and which use a solvent consisting of a dense fluid under pressure such as carbon dioxide, in the liquid state or alternatively in the supercritical state, are also known.

In such methods, the carbon dioxide may be used in place of organic solvents.

Carbon dioxide $CO_2$ has a critical point at a pressure of 73 bar (7.3 MPa) and a temperature of 31° C.

These cleaning methods employ carbon dioxide at a pressure higher than the critical pressure and at a temperature which may be lower than the critical temperature, the carbon dioxide then being liquid, or alternatively at a temperature higher than the critical temperature, the carbon dioxide then being in a supercritical state that is intermediate between the liquid and gaseous states.

The critical pressure and temperature values for $CO_2$, which are not very difficult to achieve, allow industrial application.

In the supercritical state, the properties of $CO_2$, such as its density, its viscosity which is slow, and its diffusion coefficient which is high, and its very good dissolving power with respect to numerous substances, make it a solvent product that is advantageous for the purposes of cleaning, purifying and treating materials.

In the supercritical state, $CO_2$ in particular dissolves most organic compounds.

Other substances, such as certain alkanes, may have similar properties in the supercritical state.

In the case of turbocompressors which have an inlet into which a gas involved in a process in which the gas undergoes a physical or chemical transformation is introduced, it is generally desirable for the dirt inside the turbocompressor to be removed continuously while this turbocompressor is in operation. It has been proposed that a substance capable of dissolving the dirt deposited inside the turbocompressor be introduced into the stream of process gas at the inlet of the turbocompressor.

At the outlet of the turbocompressor, fluid consisting of the process gas and of the substance in the supercritical state containing the dirt in the dissolved state is collected. The process gas and the fluid consisting of the substance containing the dirt in the dissolved state have then to be separated.

In order to clean the compressor under economical conditions, it is obviously desirable for the substance used to dissolve the dirt in the internal parts of the turbocompressor to be regenerated and recycled. In order to do this, it is necessary to separate the impurities consisting of the dirt which has been dissolved by the substance in the supercritical state to be separated from the substance used for cleaning. This separating of the impurities cannot be achieved continuously, in the stream of dissolving substance circulating through the compressor under conditions which are economical enough to be acceptable in the context of an industrial process.

The reason for this is that in order to separate impurities continuously in the stream of dissolving substance, it is generally necessary to get around the critical point of the fluid by thermodynamic transformations in a well-defined order. It is necessary to reduce the pressure of the substance in order to cause it to vaporize, the impurities in the liquid or solid state thus being separated from the substance in the gaseous state.

It is then necessary to recompress the substance in order to reintroduce it into the process circuit, inside the compressor, in a supercritical state. In order to pressurize the dissolving substance it is necessary to use a high-delivery compressor or pump, the installation and running costs of which are generally incompatible with economical implementation of an industrial process using the process gas.

It is therefore desirable to have available a method for operating turbomachines which makes it possible to limit the extent to which they become soiled, without having to regenerate and recycle a cleaning substance continuously while the turbomachine is operating.

The use of the compressor to circulate the dissolving substance is generally incompatible with the rating of the compressor, because of the pressure and developed power level needed for a constant rotational speed

BRIEF DESCRIPTION OF THE INVENTION

The object of the invention is therefore to propose a method for operating a turbomachine comprising an inlet and an outlet for a process gas circulated through a circuit known as the process circuit, that makes it possible to limit the soiling of the internal parts of the turbomachine with dirt originating from the process gas, without having to constantly circulate, regenerate and recycle a cleaning substance throughout all the operating phases of the turbomachine.

To this end, the method according to the invention is characterized in that, in between at least two successive phases in which the turbomachine is operated normally, during which phases only process gas is introduced into the inlet of the compressor and the process gas is recovered for use, a cleaning phase is carried out during which a substance in a dense state capable of dissolving the dirt on the internal parts of the turbomachine is introduced into the process circuit at the inlet of the turbomachine and the process gas and the substance in which the dirt is dissolved in the form of impurities in the liquid state are separated.

In order to provide a clear understanding of the invention, a method for operating a turbocompressor making it possible to limit the soiling of the turbocompressor and the device used to implement the method will be described by way of example with reference to the appended figures.

DETAILED DESCRIPTION OF THE INVENTION

Figure 1:
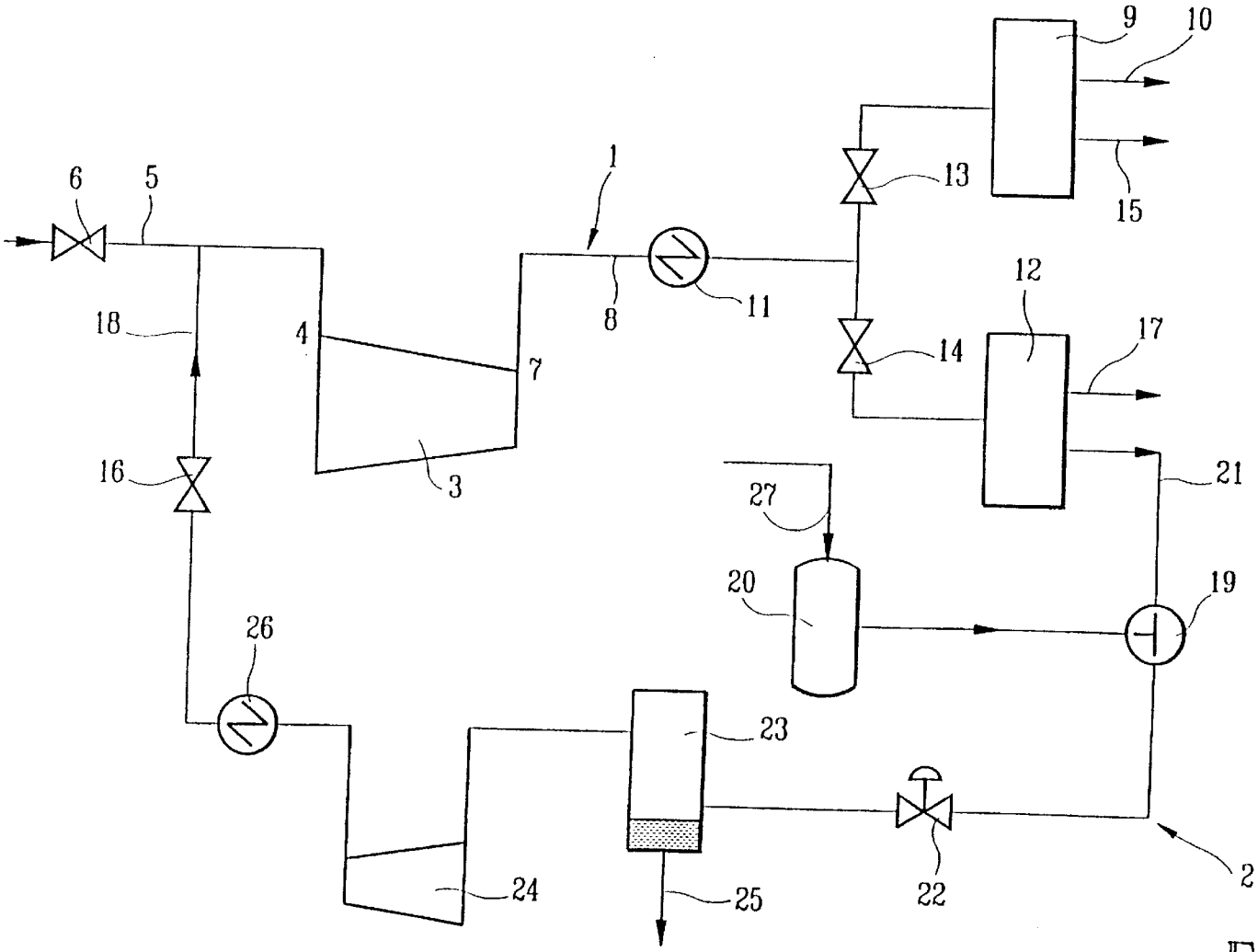
FIG. 1 shows a first embodiment of the present invention.
Figure 2:
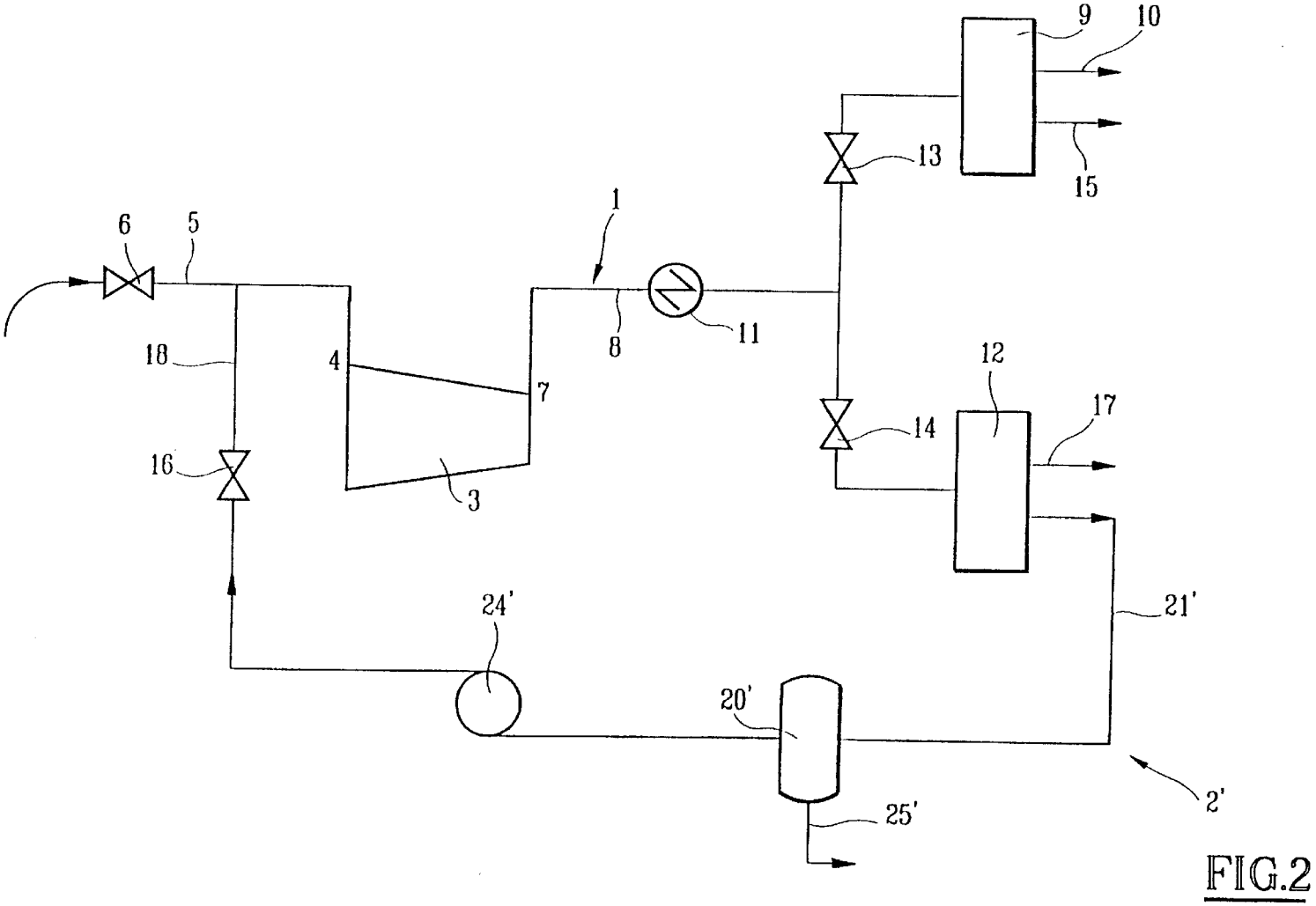
FIG. 2 shows a second embodiment of the present invention.

The installations depicted respectively in FIGS. 1 and 2, which allow the method of the invention to be implemented in a first embodiment and in a second embodiment differ only in the make-up of the turbocompressor cleaning circuit. In either instance, the same user circuit or process circuit 1 is used. As a result, only the process circuit relating to the embodiment of FIG. 1 will be described, the elements in FIGS. 1 and 2 which correspond to each other having the same references.

By contrast, the cleaning circuits 2 and 2' differ in the case of the first and in the case of the second embodiment of the method of the invention.

The cleaning circuit 2 of the embodiment depicted in FIG. 1 makes it possible, during phases in which the turbocompressor is being cleaned, for the dense cleaning substance consisting of $CO_2$ in the supercritical state to be constantly regenerated.

In the case of the second embodiment depicted in FIG. 2, the cleaning circuit 2' performs no regeneration of the substance used, which is also $CO_2$ in the supercritical state, during the cleaning phases, the supercritical $CO_2$ containing dissolved impurities being recycled in the process circuit 1. The supercritical $CO_2$ containing impurities is collected in a storage container at the end of the cleaning phase, before a further normal phase of operation of the installation is resumed. During the phase of normal operation of the installation following the cleaning phase, it is possible for the supercritical $CO_2$ saturated with impurities to be removed to a regeneration installation.

The process circuit 1, in the case of the first and second embodiments, comprises a turbocompressor 3, the inlet part 4 of which is connected to a pipe 5 via which process gas arrives from the circuit 1. The process gas arriving at the compressor 3 via the pipe 5 contains dirt. A shut-off valve 6 allows the process gas inlet to the circuit 1 to be shut off. The turbocompressor 3 has an outlet part 7 connected to a pipe 8 for discharging the gas compressed in the turbocompressor to a separator 9 and a pipe 10 for transferring the compressed gas to a user installation. A heat exchanger 11 allowing the process gas to be cooled as it leaves the turbocompressor 3 is located on the pipe 8. The pipe 8 is connected by a first branch, on which there is a shut-off valve 13, to the first gas-liquid separator 9 which consists of a filtration unit and, by a second branch on which there is a shut-off valve 14, to a second gas-liquid separator 12 which also consists of a filtration unit.

During normal operation of the installation comprising the turbocompressor, the process gas containing dirt is introduced into the inlet part 4 of the turbocompressor, is compressed and is then discharged through the outlet part 7 of the turbocompressor in the pipe 8. During phases of normal use of the installation, the shut-off valve 14 is closed and the valve 13 is open. The compressed and cooled process gas is introduced into the separator 9 which allows impurities consisting of condensate to be separated from the process gas. The condensate is discharged through the pipe 15. The compressed process gas is discharged through the pipe 10 to an installation where it is used.

The cooling of the process gas by the heat exchanger 11 is regulated according to the end-use of the process gas.

During normal operation of the turbocompressor, contaminating substances contained in the process gas are deposited on internal parts of the turbocompressor 3, such as the vanes or diffusers, these contaminating substances constituting dirt in the internal part of the compressor. The amount of dirt deposited on the internal parts of the compressor may increase with compressor running time, which leads to the drawbacks mentioned hereinabove.

According to the invention provision is made for a cleaning phase performed using, in the process circuit, upstream of the inlet to the turbocompressor 3, a substance that dissolves the dirt and which consists of a chemical compound in a dense and preferably supercritical state to be carried out between two successive phases of normal operation of the compressor, during which phases the internal part of the compressor becomes filled with dirt.

As a preference, supercritical $CO_2$ is used for cleaning the compressor.

In the case of the installation depicted in FIG. 1 and in the case of the installation depicted in FIG. 2, use is made of a cleaning circuit 2 or 2' which involves the second gas-liquid separator 12 and which can be completely isolated from the process circuit 1 using the shut-off valve 14 and using a shut-off valve 16 located on a pipe 18 itself connected to the pipe 5 of the normal user circuit 1 downstream of the shut-off valve 6. The cleaning circuit 2 or 2' is thus branched off the process circuit 1 on each side of the inlet 4 and outlet 7 of the turbocompressor 3.

In order to operate the cleaning circuit 2 or the cleaning circuit 2', the valve 13 of the process circuit is closed and the valves 14 and 16 of the cleaning circuit 2 or 2' are opened.

In the case of the installation depicted in FIG. 1, which allows the method of the invention to be implemented according to a first embodiment, use is made of a feed reservoir 20 containing $CO_2$ in the supercritical state which is placed as a branch of the circuit 2, downstream of the separator 12 on an outlet pipe 21 of the separator 12. A three-way valve 19 allows the feed reservoir 20 to be placed in communication with the pipe 21 of the cleaning circuit 2 so as to introduce supercritical $CO_2$ into the cleaning circuit 2 or so as to isolate the pipe 21 from the feed reservoir 20. At the start of the cleaning phase, clean supercritical $CO_2$ is introduced into the storage reservoir 20 via the pipe 27. The cleaning circuit 2 is then fed from the feed reservoir 20 by opening the three-way valve 19.

The supercritical $CO_2$ introduced into the circuit 2 reaches the pipe 18 to be introduced into the process circuit 1 and into the inlet part 4 of the turbocompressor 3, mixed with the process gas let into the process circuit via the pipe 5.

The supercritical $CO_2$ circulating with the process gas through the turbocompressor 3 dissolves the dirt deposited on the internal parts of the turbocompressor. Compressed process gas containing $CO_2$ containing dirt in the dissolved state is collected in the outlet part 7 of the turbocompressor 3.

The process gas containing the dirt dissolved in the $CO_2$ is cooled in the heat exchanger 11 which causes the $CO_2$ containing the impurities contained in the process gas to condense.

The mixture which reaches the inlet of the separator 12 consisting of a filtration unit, therefore comprises the compressed process gas and a liquid part consisting of the $CO_2$ containing the dissolved impurities.

The second separator 12 separates the compressed process gas which is discharged to the user installation via a pipe 17 and the liquid mixture of $CO_2$ and impurities which is discharged by the pipe 21 of the cleaning circuit 2.

The liquid phase consisting of $CO_2$ and impurities undergoes a pressure reduction brought about by a pressure-reducing valve 22, so that downstream of the pressure-reducing valve 22, the fluid circulating through the cleaning circuit 2 consists of $CO_2$ in the gaseous form and dissolved impurities in the liquid state. The fluid passes through a separator 23 of the cleaning circuit 2 consisting of a gas-liquid separator filter. The separator 23 separates the gaseous $CO_2$ which is sent via an outlet pipe to a compressor 24 and the dissolved impurities in the liquid state or possibly in the solid state which are discharged from the separator 23 through a discharge pipe 25.

The purified gaseous $CO_2$ is compressed by the compressor 24 and passes through a heat exchanger 26 which raises the temperature of the compressed $CO_2$ so that on exiting the heat exchanger 26, the fluid circulating through the cleaning circuit 2 consists of clean supercritical $CO_2$ which can be sent back to the process circuit 1, via the pipe 18.

The cleaning circuit can thus be operated continuously until satisfactory cleaning of the internal parts of the turbocompressor 3 is achieved.

At the end of the cleaning phase, the valves 14 and 16 are closed and the shut-off valve 13 of the process circuit is opened. Thus begins a further phase of normal operation of the turbocompressor 3 and of the installation. The three-way valve 19 is placed in a position which allows the cleaning $CO_2$ to be collected in the feed container 20.

Thus, the installation comprising the turbocompressor 3 can operate continuously with intermittent cleaning phases that make it possible to void excessive soiling of the turbocompressor 3. The duration of the phases of normal operation and of the cleaning phases is regulated in such a way as to avoid excessive soiling of the turbocompressor 3 while at the same time limiting the additional power consumption due, in particular, to the use of the compressor 24 on the cleaning circuit 2.

In the case of the installation depicted in FIG. 2, the process circuit 1 is identical to the process circuit used in the first embodiment. In addition, the cleaning circuit 2' comprises, as before, the shut-off valves 14 and 16 and the second separator 12 that allows a liquid phase consisting of $CO_2$ containing the dirt from the turbocompressor 3 in the dissolved state to be collected on the pipe 21' of the cleaning circuit 2' during cleaning.

The cleaning circuit according to the second embodiment in which the dissolving substance is not regenerated has a simpler structure than the cleaning circuit 2 of the first embodiment.

The cleaning circuit comprises, following the separator 12, a reservoir 20' for collecting the $CO_2$ and a pump 24'.

To carry out cleaning, clean $CO_2$ in the supercritical state is introduced at the start of the cleaning phase into the $CO_2$ collection reservoir 20'.

The supercritical $CO_2$ is sent by the pump 24' into the pipe 18 connected to the process circuit 1.

The supercritical $CO_2$ is mixed with process gas in the pipe 5 of the process circuit.

The way in which the installation works during the cleaning phase is identical to the way of working described above as far as the first embodiment was concerned, up to the point at which a liquid phase consisting of $CO_2$ containing impurities is collected in the pipe 21' of the cleaning circuit 2'. However, the heat exchanger 11 is set in such a way as to collect the $CO_2$ containing the liquid impurities in the supercritical state in the pipe 21'.

The supercritical $CO_2$ containing liquid impurities is collected in the storage reservoir 20', the discharge pipe 25' of which is shut off by a valve. The $CO_2$ in the supercritical state containing impurities is then drawn in by the pump 24' then delivered to the pipe 18 to be reintroduced into the process gas. Cleaning is thus performed by circulating $CO_2$ in the supercritical state through the process circuit 1 and through the cleaning circuit up to the point where the supercritical $CO_2$ becomes saturated with impurities in the liquid state. The cleaning circuit 2' is then isolated from the process circuit 1 and the supercritical $CO_2$ containing liquid impurities is collected in the collection reservoir 20'. The installation is switched back to normal operation. During the phase in which the installation is operating normally, the supercritical $CO_2$ containing dirt in the liquid state is discharged through the discharge pipe 25' from the collection container 20' and is possibly regenerated by separating the $CO_2$ and the liquid impurities, for example using a method involving reducing the pressure of and vaporizing the $CO_2$, followed by filtration.

$CO_2$ in the supercritical state is introduced into the container 20' in order to carry out a subsequent cleaning step.

In the case of the second embodiment, the installation may also operate continuously, the capacity to clean the turbocompressor 3 being limited only by the increase in the amount of impurities dissolved in the $CO_2$ in the supercritical state and it becoming saturated.

The CO2 in the liquid or supercritical state can be regenerated by allowing the liquid impurities to settle out inside a settling container or possibly inside the collection container 20'.

In order to be able to allow the turbocompressor 3 to operate continuously using the method for removing dirt during the cleaning phases interspersed between two phases of normal operation, in the case of the second embodiment, it is necessary to carry out the phase of purifying the $CO_2$ often enough to avoid unacceptable soiling of the turbocompressor during the phase of normal operation that separates two successive cleaning phases.

In other words, the rate at which the impurities are separated from the liquid or gaseous $CO_2$ needs to be higher than the rate at which the turbocompressor becomes soiled.

In the case of the first embodiment, the installation can be operated continuously without excessive soiling of the turbocompressor by regulating the duration of the successive phases of normal operation and of cleaning. The method according to the first embodiment which has the advantage of greater operational flexibility, does however have the disadvantage of requiring a higher power expenditure. This expenditure of power in fact depends on the duration of the cleaning phases interspersed between two phases of normal operation of the installation.

The invention is not restricted to the embodiment described.

In particular, it is possible, for dissolving the dirt in the turbocompressor, to use substances other than $CO_2$ in the supercritical state. Such substances may, for example, be water ($H_2O$), propane ($C_3H_8$) or pentane ($C_5H_{12}$) in the supercritical state.

It is also possible to envision using the method according to the invention to clean equipment or installations other than centrifugal turbocompressors.

What is claimed is:

1. A method for cleaning the internal parts of a turbomachine comprising the steps:

normally operating the turbomachine in a process circuit circulating process gas that has impurities present;

interrupting normal operation of the turbomachine;

commencing a cleaning cycle of the turbomachine;

continuing to supply a process gas to the process circuit, at an inlet of the turbomachine during the cleaning cycle;

introducing a dense cleaning substance into the process circuit, at an inlet of the turbomachine;

subjecting the circulating process gas to mixing with the cleaning substance in the turbomachine;

subjecting the internal parts of the turbomachine to the mixed cleaning substance resulting in impurities dissolved in a resulting liquefied cleaning substance; and separating the process gas from the liquefied cleaning substance having the impurities dissolved therein.

2. The method set forth in claim 1, further comprising the steps:

subjecting the liquefied cleaning substance, having impurities dissolved therein, to pressure reduction causing the cleaning substance to change to a gaseous state and causing the impurities to remain in a liquid state;

separating the cleaning substance in a gaseous state from the impurities in a liquid state;

subjecting the gaseous cleaning substance to compression and heat to change it to a dense cleaning substance;

collecting the dense cleaning substance; and recycling the dense cleaning substance to the inlet of the turbomachine for mixing with process gas thereat.

3. The method set forth in claim 1, further comprising the steps of:

recycling the liquefied cleaning substance having the impurities dissolved therein to the inlet of the turbomachine for mixing with process gas thereat; and collecting the liquefied cleaning substance having the impurities dissolved therein after passage through the turbomachine.

4. The method set forth in claim 3, wherein during normal operation of the turbomachine, the collected liquefied cleaning substance having the impurities dissolved therein undergo separation.

5. The method set forth in claim 1, wherein the dense cleaning substance is carbon dioxide in the supercritical state.

6. The method set forth in claim 1, wherein the dense cleaning substance is selected from the group including at least one of the following in the supercritical state: water, propane, and pentane.

7. An apparatus for cleaning the internal parts of a turbomachine comprising:

a turbomachine having an inlet and an outlet through which process gas flows;

a normally operating process circuit connected to the turbomachine for circulating process gas to a delivery point;

a cleaning circuit connected as a branch of the process circuit and connected across the inlet and outlet of the turbomachine; and a plurality of shut off valves for respectively opening either the cleaning or the process circuit thereby selectively placing only one of the circuits in service.

8. The apparatus set forth in claim 7, wherein the cleaning circuit is connected between a first point of the process circuit downstream of the turbomachine outlet; and a second point of the process circuit, upstream of the inlet of the turbomachine; and further wherein the cleaning circuit includes the following connected serially:

a first shut off valve for selectively closing off flow between the first point and the cleaning circuit;

a gas-liquid separator;

a three way valve connected at an outlet thereof to a reservoir for storing the cleaning substance in which impurities are dissolved;

a pressure reducing valve;

a gas/liquid filtration unit;

a compressor;

a heat exchanger; and a second shut off valve for selectively closing off flow between the second point and the cleaning circuit; and still further wherein the process circuit includes a heat exchanger located between the outlet of the turbomachine and the cleaning circuit.

9. The apparatus set forth in claim 7, wherein the cleaning circuit is connected between a first point of the process circuit downstream of the turbomachine outlet; and a second point of the process circuit, upstream of the inlet of the turbomachine; and further wherein the cleaning circuit includes the following connected serially:

a first shut off valve for selectively closing off flow between the first point and the cleaning circuit;

a gas-liquid separator;

a collection reservoir having a discharge pipe a pump; and a second shut off valve for selectively closing off flow between the second point and the cleaning circuit.

* * * * *